US012173486B2

(12) United States Patent
Peabody

(10) Patent No.: US 12,173,486 B2
(45) Date of Patent: Dec. 24, 2024

(54) SHOWER CURTAIN ROD FACILITATING DUAL SHOWER HEADS

(71) Applicant: Daniel Kenneth Peabody, Lindon, UT (US)

(72) Inventor: Daniel Kenneth Peabody, Lindon, UT (US)

( * ) Notice: Subject to any disclaimer, the term of this patent is extended or adjusted under 35 U.S.C. 154(b) by 209 days.

(21) Appl. No.: 18/092,135

(22) Filed: Dec. 30, 2022

(65) Prior Publication Data

US 2023/0212842 A1 Jul. 6, 2023

Related U.S. Application Data

(60) Provisional application No. 63/295,375, filed on Dec. 30, 2021.

(51) Int. Cl.

| | |
|---|---|
| ***E03C 1/02*** | (2006.01) |
| ***A47H 1/02*** | (2006.01) |
| ***E03C 1/04*** | (2006.01) |

(52) U.S. Cl.

CPC ..... *E03C 1/021* (2013.01); *A47H 1/02* (2013.01); *E03C 1/0408* (2013.01); *A47H 2001/0215* (2013.01)

(58) Field of Classification Search

CPC ..... E03C 1/021; E03C 1/0408; A47H 1/02; A47H 2001/0215

USPC ..... 4/601

See application file for complete search history.

(56) References Cited

U.S. PATENT DOCUMENTS

| | | | | |
|---|---|---|---|---|
| 3,822,826 | A | 7/1974 | Wilson | |
| 3,913,839 | A | 10/1975 | Wilson | |
| 5,564,139 | A | 10/1996 | Shorr | |
| 5,799,346 | A | 9/1998 | Tiernan | |
| 9,095,861 | B2 | 8/2015 | Costello | |
| 2009/0044329 | A1* | 2/2009 | Kestian | E03C 1/0408 4/612 |
| 2009/0094737 | A1* | 4/2009 | Tracey | A47K 3/28 4/596 |
| 2022/0251811 | A1* | 8/2022 | Skaloud | B05B 15/628 |

* cited by examiner

*Primary Examiner* — Huyen D Le

(74) *Attorney, Agent, or Firm* — Nelson IP; Daniel P. Nelson

(57) ABSTRACT

An apparatus for providing dual shower heads includes a shower curtain rod comprising a first end, a second end, and a hollow portion extending between the first end and the second end. A water hose is routed through the hollow portion between the first end and the second end. The water hose may exit the shower curtain rod through apertures located proximate the first end and the second end. The water hose includes a first end that is configured to receive water from plumbing at or near a first shower head, and a second end configured to deliver water to a second shower head. In this way, water is delivered to the second shower head through the shower curtain rod.

20 Claims, 5 Drawing Sheets

SHOWER CURTAIN ROD FACILITATING DUAL SHOWER HEADS

FIELD OF THE INVENTION

This invention relates to apparatus and methods for implementing dual shower heads in a shower designed for a single shower head.

BACKGROUND OF THE INVENTION

Most showers in residential properties are designed for a single shower head. Although effective, this setup is not ideal when several people want to shower at the same time or when a single person wants shower coverage on both sides of his or her body simultaneously. In other cases, a person may want two different shower heads at different heights, such as to teach a child how to shower on his or her own, or to bathe an infant or pet at or near the shower floor. Furthermore, while not the most glamourous of benefits, a double shower head provides added practicality when it comes to cleaning the shower. A hand-held shower head makes cleaning a bath or shower enclosure much quicker and easier, and having two shower heads means one shower head can be used to clean the other. Nevertheless, once a shower is designed, it can be costly to modify the shower to install a second shower head without tearing into walls, installing new plumbing, or utilizing external and unsightly pipes and hoses.

SUMMARY

The invention has been developed in response to the present state of the art and, in particular, in response to the problems and needs in the art that have not yet been fully solved by currently available apparatus and methods. Accordingly, apparatus and methods in accordance with the invention have been developed to elegantly and inexpensively provide dual shower heads in a shower. The features and advantages of the invention will become more fully apparent from the following description and appended claims, or may be learned by practice of the invention as set forth hereinafter.

Consistent with the foregoing, an apparatus for providing dual shower heads includes a shower curtain rod comprising a first end, a second end, and a hollow portion extending between the first end and the second end. A water hose is routed through the hollow portion between the first end and the second end. The water hose may exit the shower curtain rod through apertures located proximate the first end and the second end. The water hose includes a first end that is configured to receive water from plumbing at or near a first shower head, and a second end configured to deliver water to a second shower head. In this way, water is delivered to the second shower head through the shower curtain rod.

In certain embodiments, the shower curtain rod is curved. This may provide various advantages as will be discussed below. In other embodiments, the hose is compressible such that the first and second ends of the hose may be pushed into or pulled out of the ends of the shower curtain rod. This may allow the lengths of the hose that are extending out of the shower curtain rod to be adjusted, or in other cases allow the hose to be pushed into the shower curtain rod and hidden, such as when the hose is not in use. It may also allow the hose to be removed from the shower curtain rod altogether.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which.

DETAILED DESCRIPTION

It will be readily understood that the components of the present invention, as generally described and illustrated in the Figures herein, could be arranged and designed in a wide variety of different configurations. Thus, the following more detailed description of the embodiments of the invention, as represented in the Figures, is not intended to limit the scope of the invention, as claimed, but is merely representative of certain examples of presently contemplated embodiments in accordance with the invention. The presently described embodiments will be best understood by reference to the drawings, wherein like parts are designated by like numerals throughout.

Figure 1:
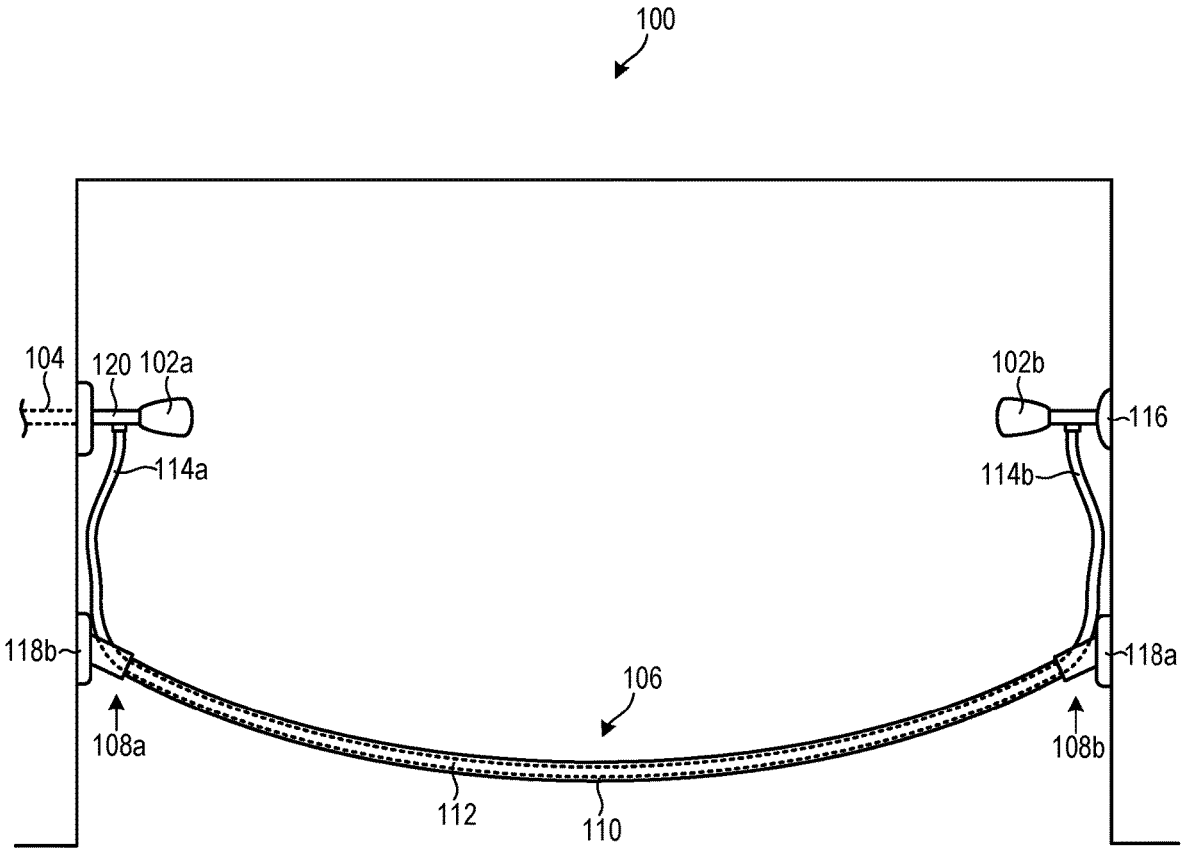
FIG. 1 is a top view showing one embodiment of a shower curtain rod for implementing dual shower heads.

Referring now to FIG. 1, as previously mentioned, most showers in residential properties are designed for a single shower head. Although effective, this setup is not ideal when several people want to shower at the same time or when a single person wants shower coverage on both sides of his or her body simultaneously. In other cases, a person may want two different shower heads at different heights, such as to teach a child how to shower on his or her own, or to bathe an infant or pet at or near the shower floor. Furthermore, while not the most glamourous of benefits, a double shower head provides added practicality when it comes to cleaning the shower. A hand-held shower head makes cleaning a bath or shower enclosure much quicker and easier, and having two shower heads means one shower head can be used to clean the other. Nevertheless, once a shower is designed, it can be costly to modify the shower to install a second shower head without tearing into walls, installing new plumbing, or utilizing external and unsightly pipes and hoses.

FIG. 1 shows a top view of one example of a shower 100 having a shower head 102*a* that is tied into existing plumbing 104 within a wall of the shower 100. In order to add a second shower head 102*b* to the shower 100 without needing to tear into walls, install new plumbing, or utilize external and unsightly pipes and hoses, a specially-designed shower curtain rod 106 may be provided. As shown, the shower curtain rod 106 may include a first end 108*a*, a second end 108*b*, and a hollow portion 110 between the first end 108*a* and the second end 108*b*. In certain embodiments, the shower curtain rod 106 includes mounts 118*a*, 118*b* at or near ends of the shower curtain rod 106 to mount the shower curtain rod 106 to walls of the shower head 102. These mounts 118*a*, 118*b* may be securely fixed to the wall (e.g., with screws or other means) or less securely (e.g., with rubber ends that press against walls of the shower 100, for example). The shower curtain rod 106 may have a fixed length or be extendable to adjust to different distances between shower walls.

As further illustrated, a flexible water hose 112 is routed through the hollow portion 110 of the shower curtain rod 106. This water hose 112 exits the shower curtain rod 106 through apertures located proximate the first end 108*a* and the second end 108*b*, respectively. The apertures may be in the tube and/or the mounts 118*a*, 118*b* of the shower curtain rod 106. The water hose 112 includes a first end 114*a* that is configured to receive water from existing plumbing 104 at, near, or built into a first shower head 102*a*, and a second end 114*b* configured to deliver water to a second shower head 102*b*. In this way, water is delivered to the second shower head 102*b* through the shower curtain rod 106. In certain embodiments, the second shower head 102*b* is a temporary shower head that is temporarily coupled to a wall of the shower 100, such as with a suction cup 116 or adhesive. This may include embodiments where the second shower head 102*b* is a wand that connects to or slides into a holder that attaches to the wall with a suction cup etc. This may allow the temporary shower head 102*b* to be removed from the wall when it is not in use or no longer needed.

As shown in FIG. 1, in certain embodiments, the shower curtain rod 106 is a curved shower curtain rod 106. This may provide various advantages. For example, this configuration may allow a gentle curve of the water hose 112, thereby eliminating right angles or other sharp turns where the water hose 112 exits the shower curtain rod 106. This may improve water pressure propagation from the first shower head 102*a* to the second shower head 102*b*. The gentle curve may also allow the water hose 112 to be more easily pushed into or pulled out of the shower curtain rod 106, thereby allowing a length of the water hose 112 that extends from the shower curtain rod 106 to be adjusted. In certain embodiments, retention clips may be provided at or near the first and second ends 108*a*, 108*b* of the shower curtain rod 106 to hold the water hose 112 in place after setting a desired hose length. In other cases, the curved configuration may enable an end of the water hose 112 to be completely pushed into the shower curtain rod 106, such as to hide it from view, or to allow the water hose 112 to be completely removed from the shower curtain rod 106 when no longer needed, or threaded back through the shower curtain rod 106 when the water hose 112 is needed again.

The water hose 112 may be connected to the existing plumbing 104 in various ways. For example, in certain embodiments, a neck of an existing shower head 102*a* may be replaced with a neck 120 that includes a fitting (or retrofitted to include a fitting) to connect to the water hose 112. The water hose 112 may then be connected to this fitting, such as by screwing the water hose 112 onto the fitting or attaching it with a quick connector. This may allow water to flow from the existing plumbing 104 into the water hose 112 and to the second shower head 102*b*. In certain embodiments, the neck 120 is replaced or supplemented with a 3-way water valve that allows water to flow to the shower head 102*a* as well as to the water hose 112.

Different variations are possible. For example, in certain embodiments, instead of having the water hose 112 exit through apertures at or near the ends 108*a*, 108*b* of the shower curtain rod 106, fittings may be provided at or near the ends 108*a*, 108*b* of the shower curtain rod 106. Shorter hoses may then attach to the fittings to couple the water hose 112 (inside the shower curtain rod 106) to the existing plumbing 104 and the second shower head 102*b* respectively.

The disclosed invention is advantageous in that it may allow the shower curtain rod 106 to still be used with a shower curtain (not shown). Because the water hose 112 exits through sides of the shower curtain rod 106 (e.g., on the inside curve of the shower curtain rod 106) as well as proximate the ends of the shower curtain rod 106, this may allow various types of hooks that are used with shower curtain rods 106 to slide freely on the shower curtain rod 106. The curved configuration of the shower curtain rod 106 may also provide additional space to a user within the shower 100.

In certain embodiments, various components shown in FIG. 1 may be provided to a consumer in the form of a kit to add a second shower head 102*b* to *h* is or her shower 100. For example, a kit may include the shower curtain rod 106, water hose 112, and shower heads, 102*a*, 102*b*. The kit may also in some embodiments include a neck 120 that includes a fitting to tap into the existing plumbing 104, and mounting hardware for a second shower head 102*b*. In other embodiments, the kit includes a 3-way water valve that can be installed directly to the existing plumbing 104 to route water to the shower head 102*a* and the water hose 112.

Figure 2:
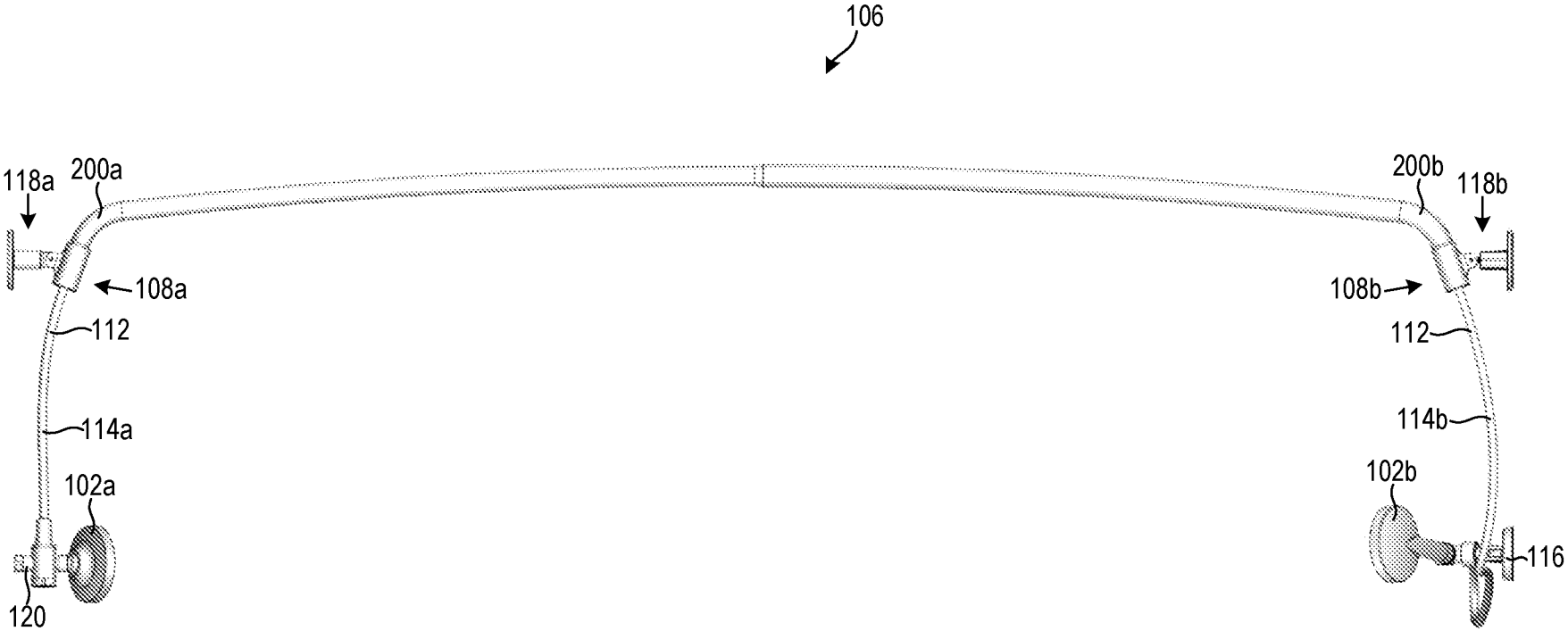
FIG. 2 is a top view of another embodiment of a shower curtain rod for implementing dual shower heads.
Figure 3:
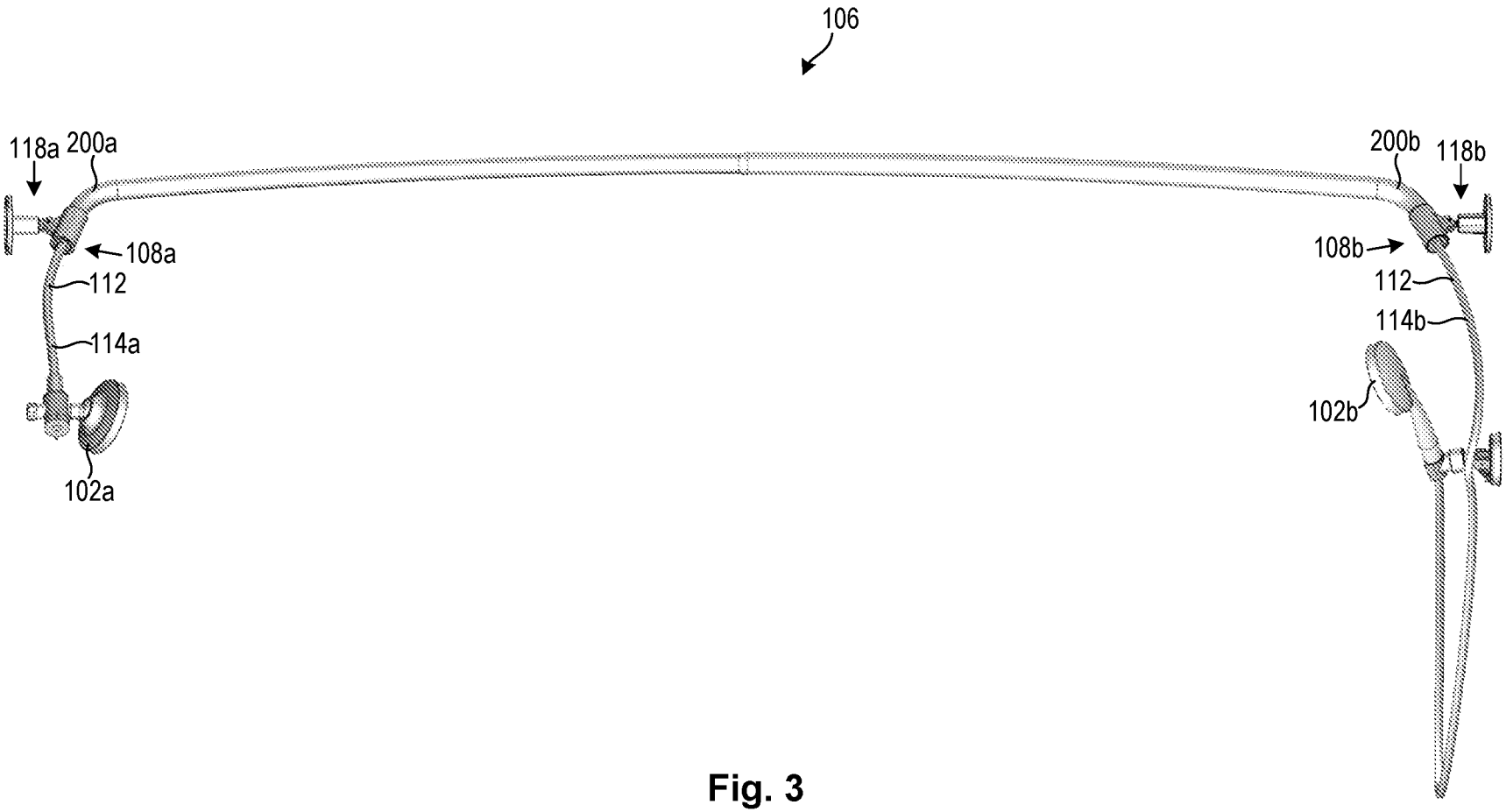
FIG. 3 is a top, side view of the shower curtain rod of FIG. 2.
Figure 4:
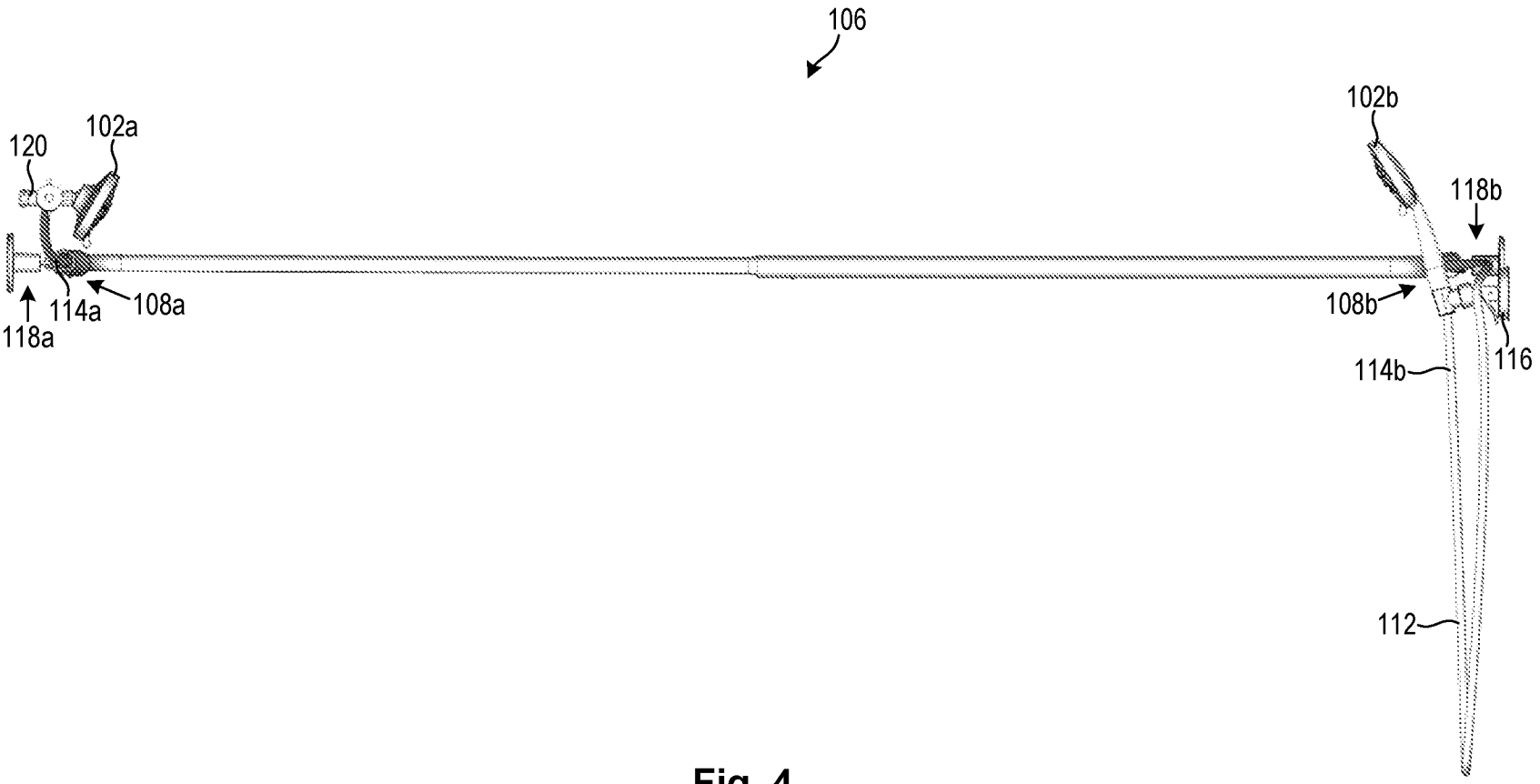
FIG. 4 is a side view of the shower curtain rod of FIG. 2.

Referring to FIGS. 2 through 4, another embodiment of the shower curtain rod 106 is illustrated. FIG. 2 is a top view of the shower curtain rod 106; FIG. 3 is a top side view of the shower curtain rod 106; and FIG. 4 is a side view of the shower curtain rod 106. In this embodiment, the shower curtain rod 106 and mounts 118*a*, 118*b* differ in certain ways compared to the shower curtain rod 106 and mounts 118*a*, 118*b* illustrated FIG. 1. For example, in this embodiment, the shower curtain rod 106 has more abrupt bends or curves at it ends and the mounts 118*a*, 118*b* are configured to accommodate these bends 200*a*, 200*b*. In this embodiment, the flexible water hose 112 extends directly from the ends of the shower curtain rod 106 as opposed to through apertures or other openings on the sides of the shower curtain rod 106 or in the mounts 118*a*, 118*b*, as shown in FIG. 1. As shown in FIGS. 2 through 4, the ends of the shower curtain rod 106 are directed toward the first shower head 102*a* and second shower head 102*b* respectively to smoothly route the flexible water hose 112 to the shower heads 102*a*, 102*b*. Furthermore, although the bends 200*a*, 200*b* are more abrupt than those illustrated in FIG. 1, the bends 200*a*, 200*b* may still be gentle enough to avoid kinks or sharp turns in the flexible water hose 112 passing through the shower curtain rod 106.

Figure 5B:
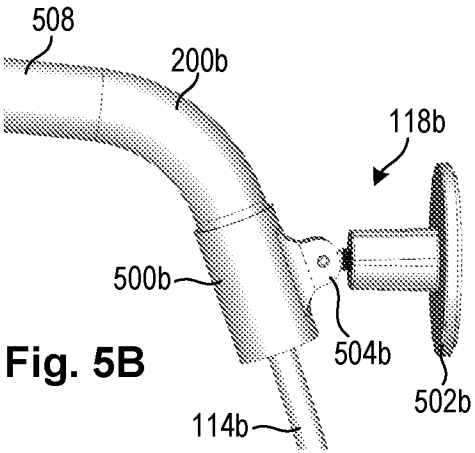
FIG. 5B is a side view of one embodiment of an extendable mount in accordance with the invention.
Figure 5C:
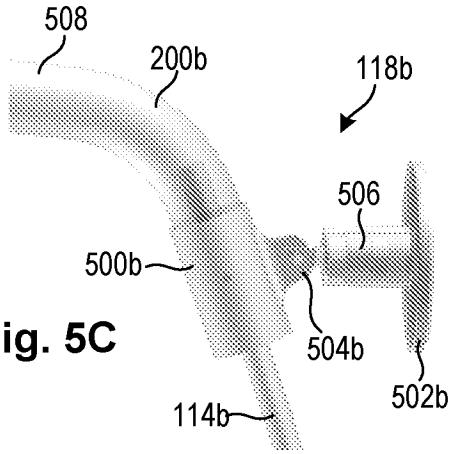
FIG. 5C is a side view of the extendable mount of FIG. 5B having some transparency to show various internal components and functionality.
Figure 5A:
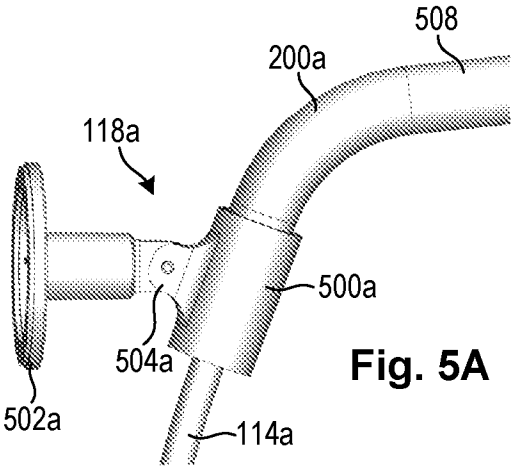
FIG. 5A is a side view of one embodiment of a fixed mount in accordance with the invention.

The more abrupt bends 200*a*, 200*b* in the shower curtain rod 106 may in certain embodiments utilize a significantly different mount design than what was shown in FIG. 1. As shown in FIGS. 2 through 4 as well as FIGS. 5A through 5C, in certain embodiments, the mounts 118*a*, 118*b* may include a fixed mount 118*a* and an extendable mount 118*b*. FIG. 5A is a side view of one embodiment of a fixed mount 118*a* in accordance with the invention; FIG. 5B is a side view of one embodiment of an extendable mount 118*b* in accordance with the invention; and FIG. 5C is a side view of the extendable mount 118*b* of FIG. 5B with some transparency to show various internal components and functionality.

As shown in FIG. 5A, in certain embodiments, the fixed mount 118*a* includes a mounting face 502*a* and a sleeve 500*a*. As shown, the sleeve 500*a* may encompass and retain a tubular portion 508 of the shower curtain rod 106. The mounting face 502 may be attached to or be pressed against a wall (e.g., with rubber or a suction cup) to maintain the position of the shower curtain rod 106 with respect to the shower wall. In certain embodiments, an articulating joint 504 may enable the mounting face 502*a* to pivot with respect to the sleeve 500*a*. The mount 118*a* may be "fixed" because the distance between the mounting face 502*a* and the sleeve 500*a* may not change significantly even when pivoting one with respect to the other.

The extendable mount 118*b*, by contrast, may be configured to expand in length to retain the shower curtain rod 106 between the walls of a shower using compressive forces. The extendable mount 118*b* may accomplish this in various different ways and with various different structures. For example, in one embodiment, an externally threaded member and one or more internally threaded members may be included in the extendable mount 118*b* to lengthen the extendable mount 118*b* by rotating the externally threaded member relative to the internally threaded members. This extension in length may be used to generate compressive forces between the walls of a shower. In other embodiments, a spring, pneumatic cylinder, hydraulic cylinder, or the like may also be used to expand the length of the extendable mount 118*b* either with or without the externally and internally threaded members. Like the fixed mount 118*a*, the extendable mount 118*b* may, in certain embodiments, include a mounting face 502*b*, a sleeve 500*b*, and an articulating joint 504*b* therebetween.

In certain embodiments, the length of the shower curtain rod 106 may be adjustable so that the fixed mount 118*a* and extendable mount 118*b* can retain the shower curtain rod 106 between the walls of a shower. For example, in certain embodiments, the shower curtain rod 106 may be provided in two parts with a first portion sliding into or out of a second portion to adjust the length. Once a desired length is achieved, the length may be fixed using a set screw or some other mechanism to fix the first portion relative to the second portion. The mounts 118*a*, 118*b* and more specifically the fixed mount 118*a* and the extendable mount 118*b* may then be used to retain the fixed-length shower curtain rod 106 between the walls of a shower using the compressive forces that are generated by the extendable mount 118*b*.

In the above disclosure, reference has been made to the accompanying drawings which is shown by way of illustration specific implementations in which the disclosure may be practiced. It is understood that other implementations may be utilized and structural changes may be made without departing from the scope of the present disclosure. References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

While various embodiments of the present disclosure have been described above, it should be understood that they have been presented by way of example only and not limitation. It will be apparent to persons skilled in the relevant art that various changes in form and detail can be made therein without departing from the spirit and scope of the disclosure. Thus, the breadth and scope of the present disclosure should not be limited by any of the above-described exemplary embodiments, but should be defined only in accordance with the following claims and their equivalents. The foregoing description has been presented for the purposes of illustration and description. It is not intended to be exhaustive or to limit the disclosure to the precise form disclosed. Many modifications and variations are possible in light of the above teachings. Further, it should be noted that any or all of the aforementioned alternate implementations may be used in any combination desired to form additional hybrid implementations of the disclosure.

The invention claimed is:

1. An apparatus for providing dual shower heads in a shower, the apparatus comprising:

a shower curtain rod comprising a first end, a second end, and a hollow portion between the first end and the second end;

a water hose passing through the hollow portion between the first end and the second end and exiting through apertures proximate the first end and the second end, respectively;

the water hose comprising a first end configured to receive water from plumbing at or near a first shower head; and the water hose comprising a second end configured to deliver water to a second shower head.

2. The apparatus of claim 1, wherein the shower curtain rod is curved.

3. The apparatus of claim 1, wherein the hose is compressible such that the first and second ends of the hose may be pushed into ends of the shower curtain rod to adjust lengths of the hose that are extending from the shower curtain rod.

4. The apparatus of claim 1, wherein the second shower head is a temporary shower head that can be moved to different locations on a wall of a shower.

5. The apparatus of claim 1, wherein the second shower head comprises a suction cup to temporarily attach it to a wall of a shower.

6. The apparatus of claim 1, wherein a length of the shower curtain rod is adjustable.

7. The apparatus of claim 6, further comprising a mechanism to fix the length of the shower curtain rod once it is adjusted to a desired length.

8. The apparatus of claim 1, further comprising a first mount and a second mount to mount the shower curtain rod between walls of a shower.

9. The apparatus of claim 8, wherein the first mount is substantially fixed in length and the second mount is extendable in length.

10. The apparatus of claim 8, wherein each of the first mount and the second mount comprises a mounting face and a sleeve.

11. The apparatus of claim 10, wherein each of the first mount and the second mount comprises an articulating joint between its mounting face and its sleeve.

12. A method for providing dual shower heads in a shower, the apparatus comprising:

providing a shower curtain rod comprising a first end, a second end, and a hollow portion between the first end and the second end;

routing a water hose through the hollow portion between the first end and the second end and extending the water hose through apertures proximate the first end and the second end, respectively;

connecting a first end of the water hose to plumbing at or near a first shower head; and connecting a second end of the water hose to a second shower head.

13. The method of claim 12, wherein the shower curtain rod is curved.

14. The method of claim 12, wherein the hose is compressible such that the first and second ends of the hose may be pushed into ends of the shower curtain rod to adjust lengths of the hose that are extending from the shower curtain rod.

15. The method of claim 12, wherein the second shower head is a temporary shower head that can be moved to different locations on a wall of a shower.

16. The method of claim 12, wherein the second shower head comprises a suction cup to temporarily attach it to a wall of a shower.

17. The method of claim 12, further comprising adjusting a length of the shower curtain rod.

18. The method of claim 17, further comprising fixing the length of the shower curtain rod once it is adjusted to a desired length.

19. The method of claim 18, further comprising providing a first mount and a second mount to mount the shower curtain rod between walls of a shower.

20. The method of claim 19, wherein at least one of the first mount and the second mount is extendable in length to mount the shower curtain rod between walls of the shower using compressive forces.

* * * * *